US006105526A

United States Patent [19]

DePalma et al.

[11] Patent Number: 6,105,526

[45] Date of Patent: Aug. 22, 2000

[54] APPARATUS FOR SEPARATING JOINED MEMBERS AND METHOD THEREFORE

[76] Inventors: Anthony G. DePalma, 26 Hatters Hill Rd., Medfield, Mass. 02052; Thomas C. Stratton, 735 County Rte. 6, High Falls, N.Y. 12440

[21] Appl. No.: 09/270,387

[22] Filed: Mar. 16, 1999

[51] Int. Cl.[7] ..... B63B 15/00

[52] U.S. Cl. ..... 114/90; 114/382; 81/180.1

[58] Field of Search ..... 114/89, 90, 97, 114/382; 440/101; 81/180.1, 476, 488, 486, 484; 138/178, 155; 285/39

[56] References Cited

U.S. PATENT DOCUMENTS 497,797 5/1893 Jones ..... 81/180.1

4,305,316 12/1981 Lehman ..... 81/180.1

*Primary Examiner*—Ed Swinehart

*Attorney, Agent, or Firm*—Herbert L. Bello

[57] ABSTRACT

An apparatus for separating mating cylindrical members, for example mating sections of a sailboard mast. The apparatus includes either a pair of support elements or a block element and a lever arm. Each of the pair of support elements and the block element is configured to receive one of the mating sections of the sailboard mast and the lever arm is configured to receive the other of the mating sections of the sailboard mast. Connecting elements are provided for frictionally holding one of the mating sections of the sailboard mast to either the support elements or the block element and for frictionally holding the other of the mating sections of the sailboard mast to the lever arm. In operation, the lever arm is moved so as to apply a torsional force to the other of the mating section of the sailboard mast while the one of the mating sections of the sailboard mast is held in position either in the pair of support elements or in the block clement. The torsional force applied by the action of the lever arm separates the mating sections of the sailboard mast.

16 Claims, 6 Drawing Sheets

APPARATUS FOR SEPARATING JOINED MEMBERS AND METHOD THEREFORE

BACKGROUND OF THE INVENTION

1. Field of the Invention

The present invention relates to an apparatus and method for separating mating cylindrical members. More particularly, the present invention relates to an apparatus and method for separating mating sections of a sailboard mast.

2. Description of the Prior Art

Sailboarding is enjoyed by a wide variety of sporting enthusiasts throughout the world. Substantially developed in the 1970's, the sport gained increasing recognition commencing in the 1980s. This interest continued through the 1990's, culminating with acceptance of the sport by the Olympic Committee and inclusion in the Summer Olympic Games. Concomitant with the increase in active participants, has been an improvement in the technology used in connection with the sport.

A sailboard has three basic components. The first component is a surfboard. The configuration of the surfboard is selected based upon the skill of the user and the water conditions at a given location. The second component is the mast structure. Typically, the mast rig structure includes a mast, a trigonal sail, and a pair of curved booms joined at their ends. The mast rig structure is joined to the sailboard via a connection assembly which forms the final component of the sailboard.

Although the composition of the sailboard and connection assemblies has remained substantially constant, the design of the mast rig structure has seen dramatic changes. In particular, the introduction of lightweight, high tensile strength carbon and composite materials has permitted increases in the length of the mast, and thus size of the sail, while decreasing the overall weight of the sailboard. This has resulted in increased speeds and agility for sailboards.

As the overall length of sailboard masts has grown, it has become desirable to form the mast from two mating sections. This modification of the mast has become necessary in order to permit storage and movement of the sailboard from location to location. Although the mast is relatively easy to assemble, separation of the mast following use can be problematic. More particularly, dynamic stresses on the mast during use, for example, twisting, bending, and axial stress as the sailboard bounces along the surface of the water, typically results in the sections of the mast becoming jammed tightly together. The difficulty in separating the sections of the mast can be compounded by salt water, silt, and/or sand entering the connection between the two mating sections.

Currently, there is no easy and effective way to separate sailboard mast sections without damaging the material forming the mast. Twisting the ends of the mast, or impacting the mast with a solid object, can cause significant structural damage to the material forming the mast. Wrenches, although able to exert a localized torsional force useful to facilitate separation of the sections, typically cause damage to, or in extreme cases crush, the mast. Probably the most limiting factor is that even when these methods are effective they all require that a second person assist in the separation of the mast components. The individuality, and freedom, afforded by sailboarding is instantaneously lost by the necessity of requiring a second person to be present so as to assist in the disassembly of the mast.

A need exists for an apparatus and method for separating the sections of a sailboard mast that can be easily utilized by an individual and will not result in damage to the material forming the mast.

SUMMARY OF THE INVENTION

It is an object of the present invention to provide an apparatus, and a method for its use, that does not suffer from the foregoing disadvantages and limitations.

It is another object of the invention to provide an apparatus for separating members having interconnected mating cylindrical portions.

It is a further object of the invention to provide an apparatus for separating mating sections of a sailboard mast that will not cause damage to the mast.

It is yet another object of the invention to provide an apparatus that can be used on planar or irregularly shaped surfaces.

It is yet a further object of the present invention to provide an apparatus for separating the mating sections of a sailboard mast that can be used by a single individual without assistance.

It is still another object of the present invention to provide an apparatus for separating the sections of a sailboard mast that is easily and economically produced, and readily assembled.

It is still a further object of the invention to provide a method for separating the mating sections of a sailboard mast.

Other general and specific objects of the invention will in part be obvious and will in part appear hereinafter.

The apparatus of the invention assists in the separation of mating sections a sailboard mast. The apparatus generally includes a mast holding element and a lever element. In one embodiment of the invention, the mast holding element generally includes a first support element that is connected to a second support element to form a stand. This embodiment of the invention provides for a portable apparatus. In an alternative embodiment of the invention, the mast holding element is a block element. This embodiment of the invention is configured for use in, for example, a workshop. In all embodiments, the mast holding element preferably includes a first connecting element which can be used to secure the mast holding element to that section of the sailboard mast upon which the mast holding element is positioned.

When used, the first support element of the mast holding element has a first end portion and a second end portion. Normally, the first end portion of the first support element has an aperture that is configured to removably and replaceably receive one of the first section and the second section of the sailboard mast. The second end portion of the first support element typically includes a cradle element that is configured to removably and replaceably receive one of the first and second mating sections of the sailboard mast. Both the first end portion and the second end portion also include an element to connect the first support element to the second support element for forming the stand.

The second support element also has a first end portion and a second end portion. Like the first support element, the first portion of the second support element has an aperture configured to removably and replaceably receive one of either of the first or second sections of the sailboard mast. The second end portion also typically has a cradle element configured to removably and replaceably receive one of either of the first or second sections of the sailboard mast. Both the first end portion and the second end portion of the second support element also include an element to connect the second support element to the first support element.

The first and second support elements can be connected in one of two separate and distinct configurations to form the stand. The configurations permit the apparatus of the invention to be adaptable to various diameters and cross-sectional configurations of those materials used as masts and booms in connection with the sport of sailboarding. For example, the first portion of the first support element and the first portion of the second support element can be connected so that their apertures are coaxially aligned. In this configuration, the apparatus of the invention can be utilized in connection with masts having a relatively large diameter. Alternatively, the second portion of the first support clement and the second portion of the second support element can be connected such that their cradle elements cooperate to form a small aperture. This second configuration is useful in connection with sailboard booms and two-piece paddles having relatively small diameters.

As noted above, the mast holding element preferably includes a connecting element. Typically, this connecting element has a first portion and a second portion. The first portion of the connecting element generally is connected to one of the first support element and the second support element. As discussed in greater detail below, the support element to which the connecting element is joined is dependent on the configuration of the mast holding element utilized. The second portion of the connecting means is configured to be removably and replaceably connectable to that section of the sailboard mast that is positioned in either the mast receiving element or cradle element of the first and said second support elements. In operation, the connecting element frictionally engages the sailboard mast and prevents the section received therein from turning. The second portion of the connecting element can be secured using, for example, a jam cleat that is operatively connected to one of the first and said second support elements. The connecting element is normally manufactured from a webbed substrate.

In an alternative embodiment of the invention, the mast holding element is a block element. This configuration of the invention is typically used when the sailboard mast is being manipulated on, for example, a bench or other planar surface. The block element typically includes an aperture configured to receive one of either the first or second sections of the sailboard mast. The block element also generally includes a connecting element that is configured to secure the mast to the block element. This connecting element also has a first portion that is connected to the block element and a second portion that is removably and replaceably connectable to the sailboard mast. The second portion of the connecting element can be secured using, for example, a jam cleat that is operatively connected to the block element. Like the other connecting elements, this connecting element frictionally engages the surface of the sailboard mast so as to prevent its axial movement during performance of the method of the invention as described below.

The lever element is used in all embodiments of the invention as described above. The lever element is configured to be securable to the other section of the mast being manipulated by the invention. The lever element includes an arm element and its own connecting element. The arm element includes a cradle element having a configuration complementary to the external shape of the sailboard mast. With regard to the connecting element, this element again has first and second portions and can be manufactured from a webbed substrate material. The first portion of this connecting element is typically connected to the arm element. The connecting element's second portion is configured to be removably and replaceably connectable to the sailboard mast. In order to provide the desired interconnection between the lever element and sailboard mast, the connecting element frictionally engages the surface of the sailboard mast. The second portion of the connecting element can be secured using, for example, a jam cleat that is operatively connected to the lever element.

The invention also contemplates a method for the separation of one section of a sailboard mast from another section of a sailboard mast. To commence the method of the invention, a mast holding element similar to that described above is connected to one section of the sailboard mast. The mast holding element can be either free-standing or secured to a fixed surface, for example, a bench top. Next, a lever element having a configuration similar to that described above is connected to the other section of the sailboard mast. The lever element is then moved axially relative to the sailboard mast to provide opposite torsional forces on the mating sections of the mast This axial rotation is continued until the mating sections of the sailboard are movable relative to one another.

The invention accordingly comprises the steps and apparatus embodying features of construction, combinations of elements and arrangements of parts adapted to effect such steps, as exemplified in the following detailed disclosure, the scope of the invention being indicated in the accompanying claims.

BRIEF DESCRIPTION OF THE DRAWINGS

A fuller understanding of the nature and objects of the present invention will become apparent upon consideration of the following detailed description taken in connection with the accompanying drawings in which.

DETAILED DESCRIPTION OF THE PREFERRED EMBODIMENTS

Figure 1:
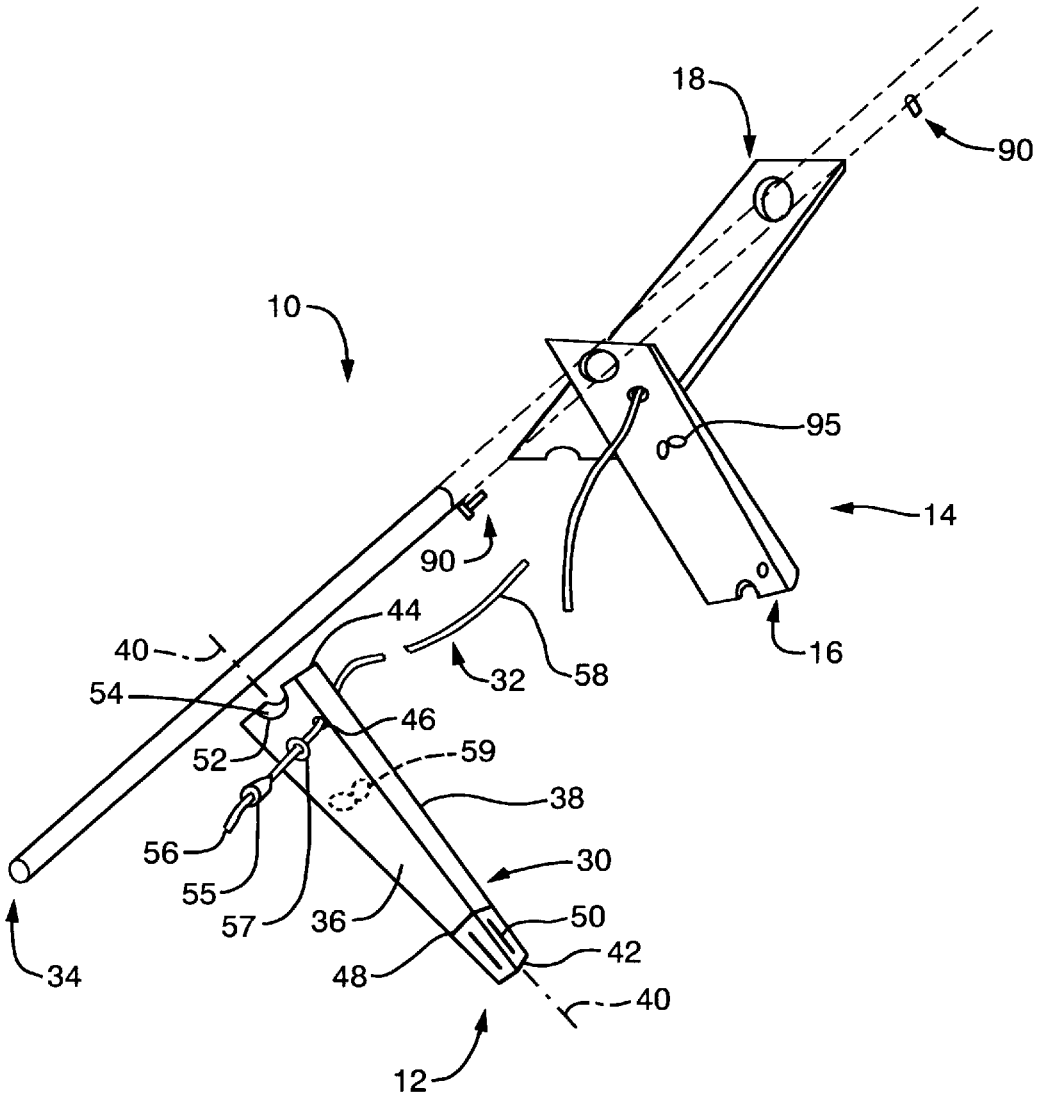
FIG. 1 is an exploded view of a first embodiment of a mast separation apparatus of the invention.
Figure 2:
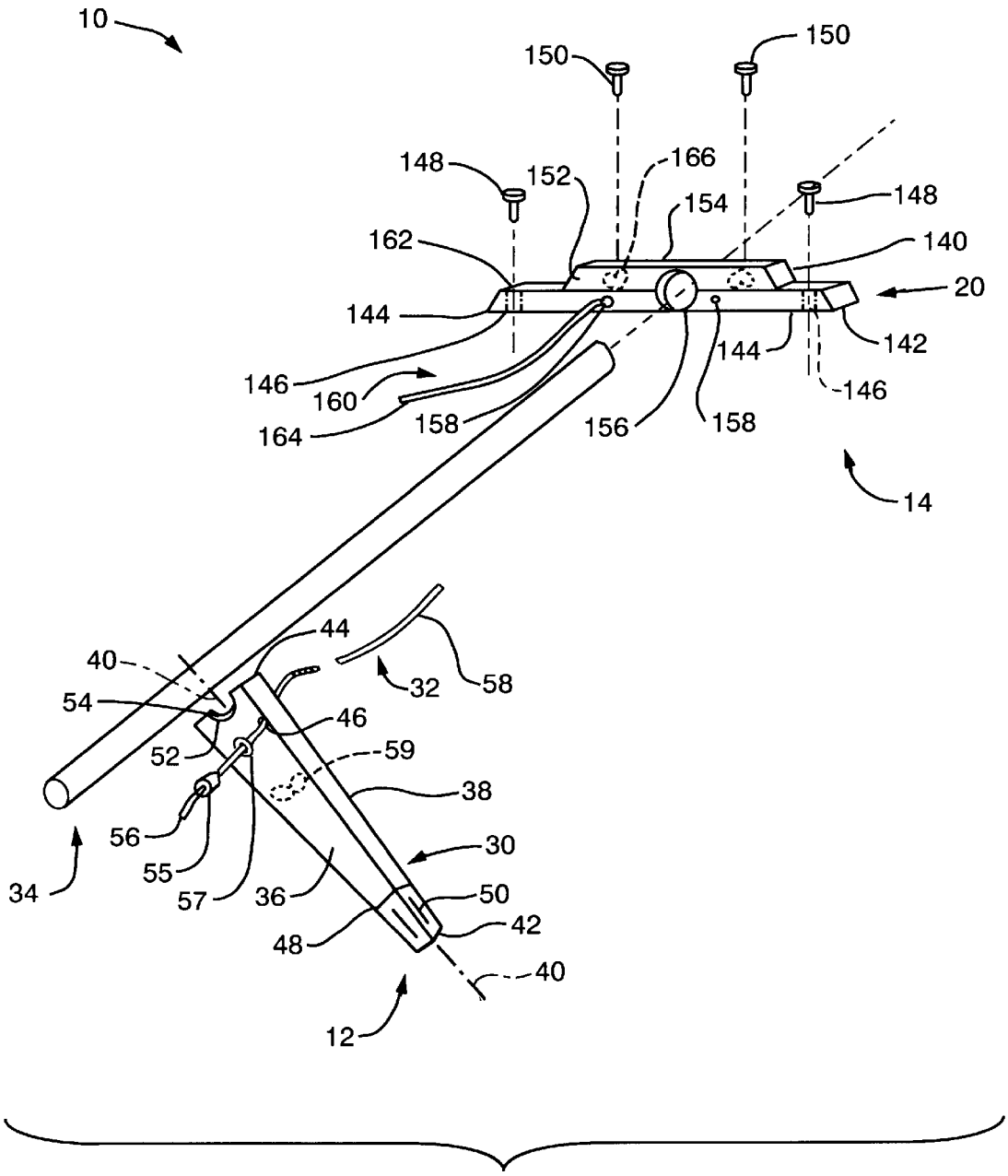
FIG. 2 is an exploded view of a second embodiment of the mast separation apparatus of the invention.
Figure 4:
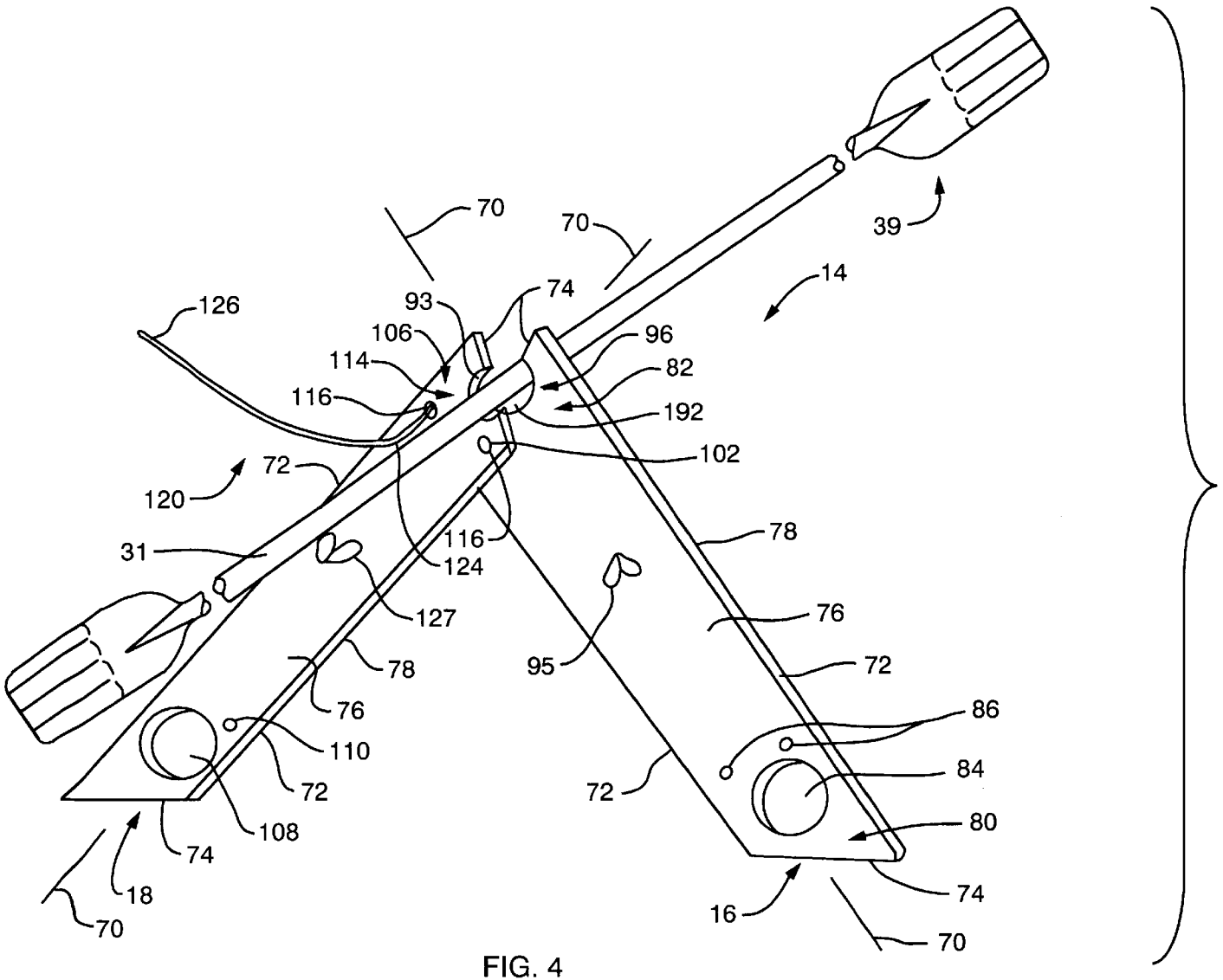
FIG. 4 is a perspective view of the support elements of the invention positioned for use in a second figuration with a two-piece paddle positioned for manipulation by the method of the invention.
Figure 5:
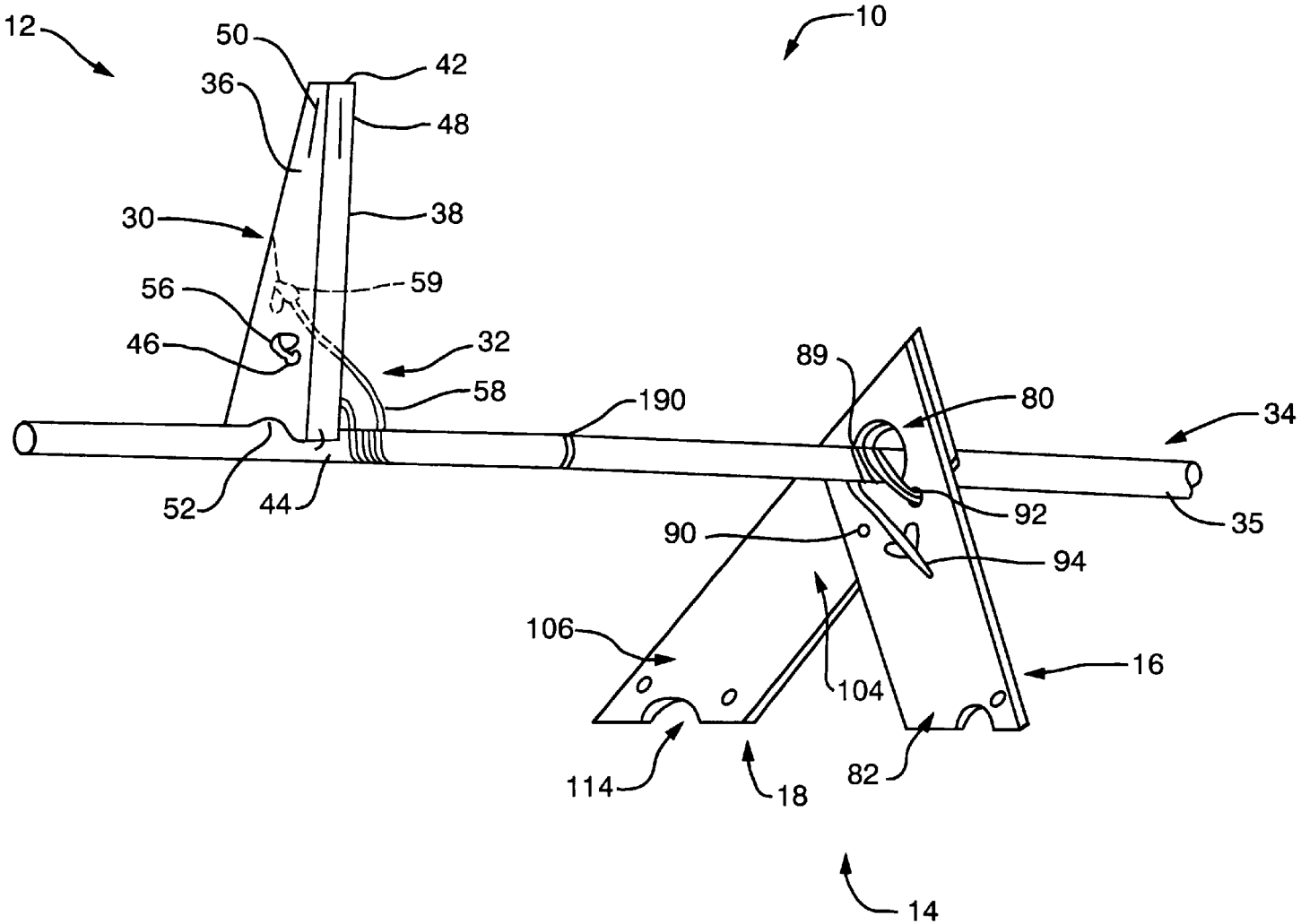
FIG. 5 is a perspective view of the first embodiment of the invention, with the support elements positioned as shown in FIG. 3, positioned for use in connection with a sailboard mast; and, FIG. 6 is a perspective view of the second embodiment of the invention positioned for use in connection with a sailboard mast.
Figure 6:
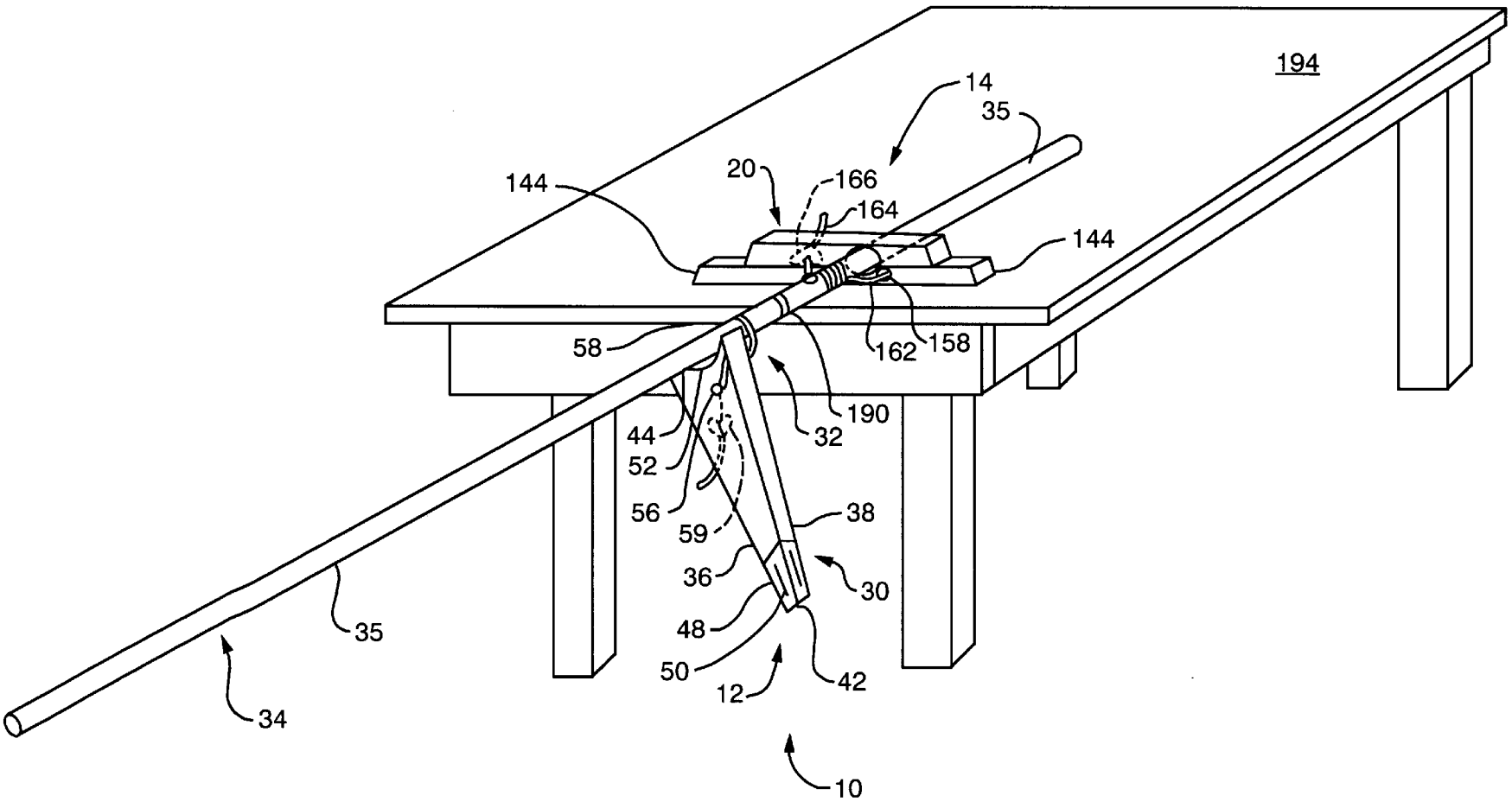

Referring now to FIGS. 1 through 6, there is shown a mast separation apparatus 10 made in accordance with the teachings of the present invention. The mast separation apparatus 10 includes a lever arm 12 and a mast holding element 14. As shown in FIGS. 1, 3, 4 and 5, the mast holding element 14 can be formed by joining a first support element 16 to a second support element 18. Alternatively, as shown in FIGS. 2 and 6 the mast holding element 14 can be formed from a block element 20.

The lever arm 12 includes an arm element 30 and a connecting element 32. As shown in FIGS. 5 and 6, in operation the connecting element 32 serves to fixably connect the arm element 30 to a sailboard mast 34. More particularly, the connecting element 32 frictionally engages one of the two sections 35 of the sailboard mast 34 and holds the sections against movement relative to the arm element 30. As discussed in detail below, in operation, the mast holding element 14 is connected to the other of the mast sections 35.

The arm element 30 has a front face 36 and a back face 38. The arm element 30 extends longitudinally along an axis 40. The termini of the axis 40 define a first end 42 and a second end 44. Preferably, the arm element 30 has a substantially truncated trigonal shape, the cross-sectional configuration of the arm element 30 being generally rectangular. The cross-sectional dimension of the arm element 30 is variable given the trigonal configuration of the arm element 30 as a whole. Those skilled-in-the-art will appreciate that the arm element 30 can have virtually any configuration providing that the selected configuration meets the mechanical strength and ergonomic requirements noted below. A through aperture 46 extends between the front face 36 and back face 38 of arm element. Typically, the aperture 46 is located in close proximity to the second end 44. The aperture 46 is sized and shaped to removably and replaceably receive at least a portion of the connecting element 32. In the illustrated embodiment, the arm element 30 is composed of wood. Those skilled in-the-art will recognize, however, that metal, plastic, and composite substrates can also be used without departing from the spirit of the invention.

As noted above, the arm element 30 extends along the axis 40. The first end 42 of the arm element 30, which is defined by one terminus of the axis 40, defined a grip element 48 for grasping the arm element 30. The grip element 48 typically is contoured to receive the hand of a user of the mast separation apparatus 10. A protective covering 50 formed of, for example, rubber, can be positioned on and over the grip element 48.

The second end 44 of the arm element 30, which is also defined by a terminus of the axis 40, includes a mast cradle element 52. The mast cradle element 52 is configured to receive a portion of one of the sections 35 of the sailboard mast 34. The mast cradle element 52 typically has a rectilinear, curved cradle face 54. The geometric configuration of the mast cradle element 52 defines the overall size and configuration of the cradle face 54. In the preferred embodiment of the invention, the mast cradle element 52 has a configuration such that the cradle face 54 will be able to come into surface-to-surface contact with a portion the outer surface of one of the sections 35 of the sailboard mast 34. As a result, the mast cradle element 52 typically has a semicircular configuration that is slightly larger that the outer diameter of one of the mast sections 35. However, it is recognized that the mast cradle element 52 can have virtually any configuration, including, for example, a "V"-shape, providing it is able to securably receive one of the sections 35 of the sailboard mast 34.

The connecting element 32 has a first end 56 and a second end 58. When the mast separation apparatus 10 is assembled for use as shown in FIGS. 5 and 6, the first end 56 of the connecting Clement 30 extends in and through the aperture 46. Upon exiting from the aperture 46, the first end 56 of the connecting element 32 is typically tied into a knot 55 so as to prevent its return passage through the aperture 46. Preferably, connecting element 32 is threaded through a washer 57 before it is knotted, the washer 57 being positioned between knot 55 and the arm element 30. Alternatively, the first end 56 of the connecting element 32 can be fastened to the front face 36 of the arm element 30 using any other technique familiar to those skilled-in-the-art. As noted in detail below in connection with FIGS. 5 and 6, the second end 58 of the connecting element 32 is configured to be positioned about and around a section 35 of the sailboard mast 34. In order to tighten and secure the connecting element 32 in position, the second end 58 of the connecting element 32 is typically affixed to the back face 38 of the lever arm 12 using a jam cleat 59 (shown in phantom). Typically, the connecting element 32 is formed from a webbed substrate and is sufficiently long to enable it to be wrapped around the mast section 35 in such a manner that the mast section and the lever arm 12 are fixed against relative movement with respect to each other. In the preferred embodiment of the invention, the connecting element 32 typically is between about two (2) and about twelve (12) feet, preferably about six (6) feet, in length and has a cross-sectional dimension of between about one-quarter (¼) inches and about three-eights (⅜) inches.

The mast holding element 14 includes a first support element 16 and a second support element 18. As shown best in FIGS. 3 and 4, the first support element 16 and the second support element 18 can be joined together in one of two possible configurations to form a stand. The configuration selected for a given application is, generally, dependent upon the diameter and cross-sectional configuration of the section 35 of the sailboard mast 34 with which the mast separation apparatus 10 of the invention is being utilized.

Both the first support element 16 and the second support element 18 extend longitudinally along an axis 70. The elements 16 and 18 have a generally rectangular cross-sectional configuration. Each of the elements 16 and 18 have a pair of substantially parallel sides 72. The termini of the axis 70 is defined by opposing ends 74. The opposing ends 74 of the support elements 16 and 18 are angularly displaced relative to each other. The angular disposition of the sides 72 and ends 74 relative to each other creates a generally trapezoidal external configuration for the element 16 and 18. The cross-sectional configuration of the support elements 16 and 18 is generally rectangular. Extending between the sides 72 and ends 74 is a front face 76 and a back face 78.

Figure 3:
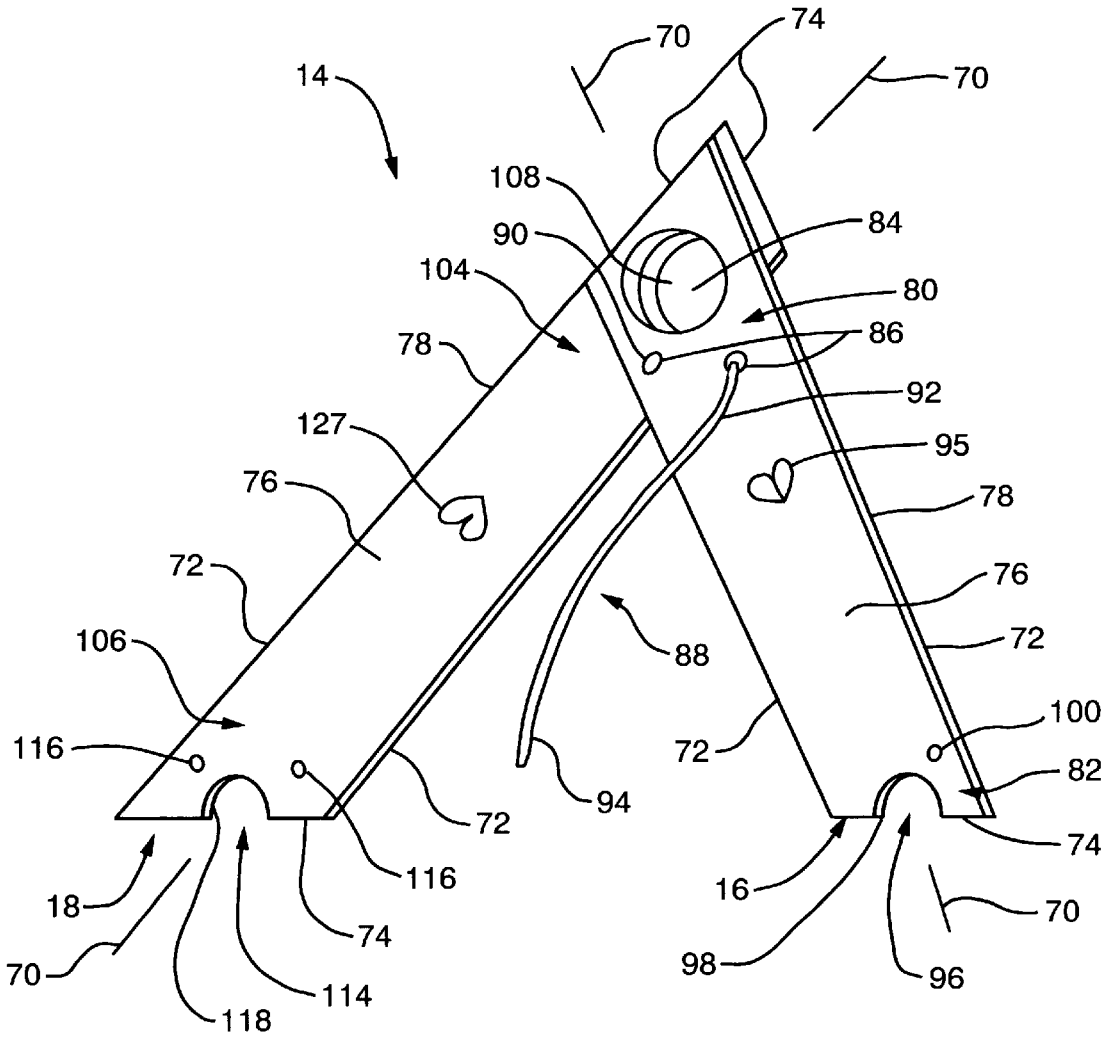
FIG. 3 is a perspective view of the support elements of the invention positioned for use in a first configuration.

The first support element 16 has a first end 80 and a second end 82. The first end 80 includes a large aperture 84 and a pair of smaller apertures 86. All of the apertures 84 and 86 extend from the front face 76 through to the back face 78. The large aperture 84 is configured, when the mast separation apparatus 10 is assembled as shown in FIGS. 3 and 5, to removably and replaceably receive a portion of a section 35 of the sailboard mast 34. At least one of the apertures 86 is configured to removably and replaceably receive a connecting element 88 described in detail below. The other of the apertures 86 is configured to removably and replaceably receive a pin element 90 useful for securing the first support element 16 to the second support element 18 so as to form the mast holding element 14 as shown in FIGS. 3 and 5. The pin element 90 can be, for example, a nut and bolt or a screw and wing nut or some other fastening means familiar to those skilled-in-the-art. In the currently preferred embodiment of the invention, the pin element 90 is a nut and bolt.

The connecting element 88 has a first end 92 and a second end 94. When the mast separation apparatus 10 is assembled for use as shown in FIGS. 3 and 5, the first end 92 of the connecting element 88 extends in and through one of the apertures 86. Upon exiting from one of the apertures 86, the first end 92 of the connecting element 88 is typically tied into a knot so as to prevent its return passage through the aperture 86. Preferably, as in the case of connecting element 32, connecting element 88 is threaded through a washer (not shown) before it is knotted, the washer being positioned between the knot and the first support element 16. Alternatively, the first end 92 of the connecting element 88 can be fastened to the back face 78 of the first support element 16 using virtually any other technique familiar to those skilled-in-the-art. As noted in detail below in connection with FIG. 5, the second end 94 of the connecting element 88 is configured to be positioned about and around a section 35 of the sailboard mast 34. As shown best in FIG. 5, in order to tighten and secure the connecting element 88 in position, the second end 94 of the connecting element 88 is typically affixed to the front face 76 of the first support element 16 using a jam cleat 95. Typically, the connecting element 88 is formed from a webbed substrate and is sufficiently long to enable it to be wrapped around the mast section 35 in such a manner that the mast section and the mast holding element 14 are fixed against relative movement with respect to one another. In the preferred embodiment of the invention, the connecting element 88 typically is between about two (2) and about twelve (12) feet, preferably about six (6) feet, in length and has a cross-sectional dimension of between about one-quarter (¼) inches and about three-eights (⅜) inches.

The second end 82 of the first support element 16 includes a cradle element 96 and an aperture 100. As shown in FIG. 4, the cradle element 96 is configured to removably and replaceably receive a portion of a section 37 of, for example, a boom of a sailboard or a two-piece paddle 39, such as a kayak paddle. Although a paddle 39 is shown in connection with FIG. 4, those skilled-in-the-art will appreciate that this embodiment of the invention can be used with virtually any component having a relatively small cross-sectional dimension, for example, a boom of a sailboard. Generally, the cradle element 96 has a curved, rectilinear face 98. The geometric configuration of the cradle element 96 defines the overall configuration of the face 98. In the preferred embodiment of the invention, the cradle element 96 has a configuration such that the face 98 will be able to come into surface-to-surface contact with a portion of the outer surface of the section 37 of the paddle 39. Accordingly, the cradle element 96 typically has a semi-circular configuration. Those skilled-in-the-art will appreciate, however, that the cradle element 96 can have virtually any configuration, including a "V"-shaped configuration providing it affords the face 98 with the ability to receive the desired section 37 of the paddle 39. The aperture 100 is configured to removably and replaceably receive a pin element 102 useful for securing the first support element 16 to the second support element 18 so as to form the mast holding element 14 as shown in FIG. 4. The pin element 102 can be, for example, a nut and bolt or a screw and wing nut or some other fastening means familiar to those skilled-in-the-art. In the currently preferred embodiment of the invention, the pin element 102 is a nut and bolt.

The second support element 18 has a first end 104 and a second end 106. The first end 104 includes a large aperture 108 and a small aperture 110. Both the large aperture 108 and small aperture 110 extend from the front face 76 through to the back face 78. The large aperture 108 is configured, when the mast separation apparatus 10 is assembled as shown in FIGS. 3 and 5, to removably and replaceably receive a portion of the section 35 of the sailboard mast 34. The small aperture 110 is configured to removably and replaceably receive a pin element 90 useful for securing the second support element 18 to the first support element 16 so as to form the mast holding element 14 as shown in FIGS. 3 and 5. As noted above, the pin element 90 can be, for example, a nut and bolt, screw, or cotter pin familiar to those skilled-in-the-art. In the currently preferred embodiment of the invention, the pin element 90 is a nut and bolt.

The second end 106 of the second support element 18 includes a cradle element 114 and a pair of apertures 116. The apertures 116 extend from the front face 76 through to the back face 78. The cradle element 114 is configured to removably and replaceably receive a portion of a section 37 of the paddle 39. Typically, the cradle element 114 has a curved, rectilinear face 118. The geometric configuration of the cradle element 114 defines the overall configuration of the face 118. In the preferred embodiment of the invention, the cradle element 114 has a configuration such that the face 118 will be able to come into surface-to-surface contact with a portion of the outer surface of a section 37 of the paddle 39. Typically, the cradle element 114 has a semi-circular configuration, however, those skilled-in-the-art will appreciate that the cradle element 114 can have virtually any configuration providing the selected configuration affords the desired level of contact between the second end 18 and the section 37 of the paddle 39. One of the apertures 116 is configured to receive a connecting element 120 described in detail below. The other aperture 116 is configured to removably and replaceably receive a pin element 102 useful for securing the second support element 18 to the first support element 16 so as to form the mast holding element 14 as shown in FIG. 4. The pin element 102 can, as noted above, be, for example, a nut and bolt, screw, or cotter pin familiar to those skilled-in-the-art. In the currently preferred embodiment of the invention, the pin element 102 is a nut and bolt.

The connecting element 120 has a first end 124 and a second end 126. When the mast holding element 14 is assembled for use as shown in FIG. 4, the first end 124 of the connecting element 120 extends in and through one of the apertures 116. Upon exiting from one of the apertures 116, the first end 124 of the connecting element 120 is typically tied into a knot so as to prevent its return passage through the aperture 116. Preferably, as hereinbefore discussed in connection with connecting element 32, connecting element 120 is threaded through a washer (not shown) before it is knotted, the washer being positioned between the knot and the second support element 18. Alternatively, the first end 124 of the connecting element 120 can be fastened to the back face 78 of the second support element 18 using any other technique familiar to those skilled-in-the-art. As discussed in detail below, the second end 126 of the connecting element 120 is configured to be positioned about and around a section 35 of the sailboard mast 34. In order to tighten and secure the connecting element 120 in position, the second end 126 of the connecting element 120 is typically affixed to the front face 76 of the second support element 18 using a jam cleat 127. Typically, the connecting element 120 is formed from a webbed substrate and is sufficiently long to enable it to be wrapped around the mast section 35 in such a manner that the mast section and the mast holding element 14 are fixed against relative movement with respect to one another. In the preferred embodiment of the invention, the connecting element 120 typically is between about two (2) and about twelve (12) feet, preferably six (6) feet, in length and has a cross-sectional dimension of between about one-quarter (¼) inches and about three-eights (⅜) inches.

The block element 20 includes an upper portion 140 joined to a lower portion 142 by fasteners 150. Preferably, the fasteners 150 exert sufficient force that once the upper portion 140 is joined to the lower portion 142 they together form a unitary structure. The upper portion 140 is centrally positioned on the lower portion 142. In the preferred embodiment of the invention as shown in FIGS. 2 and 6, the upper portion 140 has a lengthwise dimension that is less than the lengthwise dimension of the lower element 142. Accordingly, wing portions 144 of lower portion 142 extend beyond the ends of the upper portion 140. The wing portions 144 can have apertures 146 configured to removably and replaceably receive fasteners 148. The fasteners 148 can be, for example, screws or bolts. In the preferred embodiment of the invention as discussed below, the fasteners 148 can be utilized to secure the block element 20 to, for example, a bench top surface 194. The block element 20 has a front face 152 and a back face 154. The block element 20 can be manufactured from virtually any durable substrate material including, for example, wood, metal, plastic, or composite materials.

The block element 20 includes a large aperture 156 and a pair of small apertures 158. The apertures 156 and 158 extend between the front face 152 and back face 154 of the block element 20. The large aperture 156 is positioned in the block element 20 such that substantially equal portions of the large aperture 156 are defined by the upper element 140 and lower portion 142. As shown in FIGS. 2 and 6, the large aperture 156 is sized and shaped to removably and replaceably receive a portion of a section 35 of the sailboard mast 34.

The small apertures 158 are radially positioned relative to the large aperture 156. The small apertures 158 can be positioned in either the upper portion 140 or the lower portion 142 as may be required for a given application. The small apertures 158 are configured to removably and replaceably receive a connecting element 160. The connecting element 160 has a first end 162 and a second end 164. When the mast separation apparatus 10 is assembled for use as shown in FIG. 6, the first end 162 of the connecting element 160 extends in and through one of the small aperture 158. Upon exiting from the small aperture 158, the first end 162 of the connecting element 160 is typically tied into a knot so as to prevent its return passage through the aperture 158. Preferably, as hereinbefore discussed in connection with connecting element 32, connecting element 160 is threaded through a washer (not shown) before it is knotted, the washer being positioned between the knot and the block element 20. Alternatively, the first end 162 of the connecting element 160 can be fastened to the back face 154 of the block element 20 using any other technique familiar to those skilled-in-the-art. As noted in detail below in connection with FIG. 6, the second end 164 of the connecting element 160 is configured to be positioned about and around a section 35 of the sailboard mast 34. After being positioned about and around the section 35 of the sailboard mast 34, the second end 164 passes through the other small aperture 158 and exits out onto the back face 154 of the block element 20. In order to tighten and secure the connecting element 160 in position, the second end 164 of the connecting element 160 is typically affixed to the back face 154 of the block element 20 using a jam cleat 166. Typically, the connecting element 160 is formed from a webbed substrate and is sufficiently long to enable it to be wrapped around the mast section 35 in such a manner that the mast section and the block element 20 are fixed against relative movement with respect to one another. . In the preferred embodiment of the invention, the connecting element 160 typically is between about two (2) and about twelve (12) feet, preferably six (6) feet, in length and has a cross-sectional dimension of between about one-quarter (¼) inches and about three-eights (⅜) inches.

The invention also contemplates a method of separating the sections 35 of a sailboard mast 34. In the embodiment of the method as discussed in connection with FIG. 5, a sailboard mast 34 having sections 35 with a large diameter are separated. Sections 35 of a sailboard mast 34 having a smaller diameter are separated using the same method discussed in connection with FIG. 5, however, the configuration of the support elements 16 and 18 as shown in FIG. 4 is utilized. Finally, FIG. 6 shows how the apparatus of the invention is utilized in connection with a bench or other planar surface 194.

To perform the method of the invention using the apparatus of the invention as shown in FIGS. 3 and 5, the large apertures 84 and 108 are first aligned such that they are co-axial. The pin element 90 is then inserted into the apertures 86 and 110 and secured in place. The first support element 16 and second support element 18 are then placed on the ground or other surface. More particularly, the opposing ends 74 of the elements 16 and 18 are placed in contact with the ground or other surface. A section 35 of a sailboard mast 34 is then inserted into the apertures 84 and 108. Preferably, the section 35 is positioned in the apertures 84 and 108 at a location proximate to the joint 190 between the mast sections 35.

Next, the connecting element 88 is wound about and around the section 35 of the sailboard mast 34 positioned in the apertures 84 and 108 and then tightened and secured in position using jam cleat 95. The connecting element 88 is typically wound around the section 35 of the sailboard mast 34 as tightly as possible so that it will frictionally engage the surface of the section 35 of the sailboard mast 34. Frictional engagement by the connecting element 88 prevents axial movement of the section 35 of the sailboard mast 34 relative to the mast holding element 14 when force is applied to the lever arm 12.

In the next phase of the method of the invention, the lever arm 12 is secured to the other section 35 of the sailboard mast 34. To accomplish this, the other section 35 of the sailboard mast 34 is positioned within the confines of the mast cradle element 52. Preferably, the lever arm 12 is also positioned proximate to the joint 190 between the sections 35 of the sailboard mast 34. The connecting element 32 is then wound about and around the section 35 of the sailboard mast 34 such that it is securely connected thereto. Connecting element 32 is tightened and secured in position using jam cleat 59. The connecting element 32 is typically wound around the section 35 of the sailboard mast 34 as tightly as possible so that it will frictionally engage the surface of the section 35 of the sailboard mast 34. Frictional engagement by the connecting element 32 prevents axial movement of the section 35 of the sailboard mast 34 relative to the lever arm 12 when force is applied to the lever arm 12.

To complete the method of the invention, the lever arm 12 is moved such that it rotates around the section 35 of the sailboard mast 34 to which it is attached. The torsional force created by this movement causes the section 35 to which the lever arm 12 is attached to rotate while the other section 35 is held in position by the mast holding element 14. As a result, the sailboard mast 34 separates into its two sections 35.

To perform the method of the invention using the apparatus as shown in FIG. 4, the cradle elements 96 and 114 are first aligned so as to form an aperture 192. The pin element 102 is then inserted into the apertures 100 and 116 and secured in place. The first support element 16 and second support element 18 are then placed on the ground or other surface. More particularly, the opposing ends 74 of the elements 16 and 18 are placed in contact with the ground or other surface. A section 35 of the sailboard mast 34 is then inserted into the aperture 192 formed by cradle elements 96 and 114. Preferably, the section 35 is positioned in the aperture 192 at a location proximate to the joint 190 between the mast sections 35.

Next, the connecting element 120 is wound about and around the section 35 of the sailboard mast 34 inserted in aperture 192. The connecting element 120 is then tied in position. The connecting element 120 is typically wound about and around the section 35 of the sailboard mast 34 as tight as possible so that it will frictionally engage the surface of the section 35 of the sailboard mast 34. Connecting element 120 is tightened and secured in position using jam cleat 127. Frictional engagement of the section 35 prevents axial movement of the section 35 when force is applied by the lever arm 12.

In the next phase of the method of the invention, the lever arm 12 is secured to the section 35 of the sailboard mast 34. To accomplish this, the other section 35 of the sailboard mast 34 is positioned within the confines of the mast cradle element 52. Preferably, the lever arm 12 is also positioned proximate to the joint 190 between the section 35 of the sailboard mast 34. The connecting element 32 is then wound about and around the section 35 of the sailboard mast 34 such that it is securely connected thereto. Connecting element 32 is tightened and secured in position using jam cleat 59. The connecting element 32 is typically wound around the section 35 of the sailboard mast 34 as tightly as possible so that it will frictionally engage the surface of the section 35 of the sailboard mast 34. Frictional engagement by the connecting element 32 prevents axial movement of the section 35 of the sailboard mast 34 relative to the lever arm 12 when force is applied to the lever arm 12.

To complete the method of the invention, the lever arm 12 is moved such that it rotates around the section 35 of the sailboard mast 34 to which it is attached. The torsional force created by this movement causes the section 35 to which the lever arm 12 is attached to rotate while the other section 35 is held in position by the mast holding element 14. As a result, the sailboard mast 34 separates into its two sections 35.

To perform the method of the invention as shown in FIG. 6, the block element 20 is secured to, for example, a bench surface, using the fasteners 148. A section 35 of a sailboard mast 34 is then positioned in the aperture 156. Preferably, the section 35 is positioned in the aperture 156 such that the joint 190 between the sections 35 is proximate to the block element 20. The connecting element 160 is then wound about and around the section 35 sailboard mast 34. The connecting element 160 is then secured in position. Once again, the connecting element 160 is typically wound about and around the section 35 of the sailboard mast 34 as tight as possible so that it will frictionally engage the surface of the section 35 of the sailboard mast 34 so as to prevent axial movement of the section 35 when force is applied by the lever arm 12. Connecting element 160 is tightened and secured in position using jam cleat 166.

In the next phase of the method of the invention, the lever arm 12 is secured to the section 35 of the sailboard mast 34. To accomplish this, the other section 35 of the sailboard mast 34 is positioned within the confines of the mast cradle element 52. Preferably, the lever arm 12 is also positioned proximate to the joint 190 between the sections 35 of the sailboard mast 34. The connecting element 32 is then wound about and around the section 35 of the sailboard mast 34 such that it is securely connected thereto. Connecting element 32 is tightened and secured in position using jam cleat 59. The connecting element 32 is typically wound around the section 35 of the sailboard mast 34 as tightly as possible so that it will frictionally engage the surface of the section 35 of the sailboard mast 34. Frictional engagement by the connecting element 32 prevents axial movement of the section 35 of the sailboard mast 34 relative to the lever arm 12 when force is applied to the lever arm 12.

To complete the method of the invention, the lever arm 12 is moved such that it rotates around the section 35 of the sailboard mast 34 to which it is attached. The torsional force created by this movement causes the section 35 to which the lever arm 12 is attached to rotate while the other section 35 is held in position by the mast holding element 14. As a result, the sailboard mast 34 separates into its two sections 35.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall there between.

What is claimed is:

1. An apparatus for separating a first section of a sailboard mast from a second section of a sailboard mast, said apparatus comprising:

a) a mast holding means, said mast holding means including a first supporting means and a second supporting means, said first and second supporting means being removably and replaceably connectable to one another, said mast holding means having a first connecting means for connecting said mast holding means to one of the first section of the sailboard mast and the second section of the sailboard mast;

b) said first supporting means having a first end portion and a second end portion, said first end portion formed with an aperture, said aperture of said first end portion being configured to removably and replaceably receive one of the first section of said sailboard mast and the second section of the sailboard mast, said second end portion of said first supporting means having a cradle supporting means, said cradle supporting means being configured to removably and replaceably receive one of the first section of the sailboard mast and the second section of the sailboard mast, said first end portion and said second end portion each having a means for removably and replaceably connecting said first supporting means to said second supporting means;

c) said second supporting means having a first end portion and a second end portion, said first end portion formed with an aperture, said aperture of said first end portion being configured to removably and replaceably receive one of the first section of the sailboard mast and the second section of the sailboard mast, said second end portion having a cradle supporting means, said cradle supporting means being configured to removably and replaceably receive one the first section of the sailboard mast and the second section of the sailboard mast, said first end portion and said second end portion each having a means for removably and replaceably connecting said second supporting means to said first supporting means; and d) a leverage means, said leverage means being securable to the other of the first section of the sailboard mast and the second section of the sailboard mast, said leverage means having an arm engaging means and a second connecting means for connecting said leverage means to the other of the first section of the sailboard mast and the second section of the sailboard mast, said arm means having a cradle engaging means, said cradle engaging means configured to receive the other of the first section of the sailboard mast and the second section of the sailboard mast, said cradle engaging means having a configuration that is substantially complementary to the shape of the section of the sailboard mast received in said cradle engaging means, said second connecting means having a first portion connected to said arm means and a second portion removably and replaceably connectable to the section of the sailboard mast positioned in said cradle engaging means of said second portion of said second connecting means frictionally engaging the section of the sailboard mast positioned in said cradle engaging means;

(e) said first portion of said first supporting means and said first portion of said second supporting means being connectably aligned in a first configuration such that said aperture in said first portion of said first supporting means and said aperture in said first portion of said second supporting means are coaxial, said second portion of said first supporting means and said second portion of said second supporting means being connectably aligned in a second configuration such that said cradle supporting means in said second portion of said first supporting means and said cradle supporting means in said second portion of said second supporting means cooperate to form an aperture means, said first configuration being usable in connection with sections of a sailboard mast having a first diameter, said second configuration being usable in connection with sections of a sailboard mast having a second diameter, said first diameter being greater than said second diameter.

2. The apparatus of claim 1 wherein said first supporting means further comprises a means for connecting said first support means to one of the first section of the sailboard mast and the second section of said sailboard mast.

3. The apparatus of claim 2 including a jam cleat operatively connected said mast holding means for securing an end of said second portion of said first connecting means that is in frictional engagement with the sailboard mast.

4. The clamping apparatus of claim 1 wherein said second supporting means further comprises a means for connecting said second supporting means to one of the first section of the sailboard mast and the second section of said sailboard mast.

5. The clamping apparatus of claim 4 wherein said connecting means is secured to said second support means using a jam cleat.

6. The clamping apparatus of claim 1 including a jam cleat operatively connected to said leverage means for securing an end of said second portion of said second connecting means that is in frictional engagement with the sailboard mast.

7. The clamping apparatus of claim 1 wherein said second connecting means of said leverage means is formed from a webbed substrate material.

8. An apparatus for separating a first section of a sailboard mast from a second section of a sailboard mast, said apparatus comprising:

a) a block holding means, said block holding means configured to be secured to a planar surface, said block holding means formed with an aperture that is configured to receive one of the first section of the sailboard mast and the second section of the sailboard mast, said block holding means having a first connecting means, said first connecting means having a first portion connected to said block holding means and a second portion removably and replaceably connectable to the section of the sailboard mast positioned in said aperture, said second portion of said first connecting means configured to frictionally engage the section of the sailboard mast positioned in said aperture; and b) a leverage means, said leverage means being securable to the other of the first section of the sailboard mast and the second section of the sailboard mast, said leverage means including an arm engaging means and a second connecting means, said arm engaging means having a cradle engaging means, said cradle engaging means configured to receive the section of the sailboard means, said cradle engaging means having a configuration substantially complementary to the shape of the section of the sailboard means received therein, said second connecting means having a first portion secured to said arm engaging means and a second portion configured to frictionally engage a portion of the section of the sailboard mast adjacent the portion that is received in said arm engaging means.

9. The apparatus of claim 8 including a jam cleat operatively connected said block holding means for securing an end of said second portion of said first connecting means that is in frictional engagement with the sailboard mast.

10. The apparatus of claim 8 including a jam cleat operatively connected to said leverage means for securing and end of said second portion of said second connecting means that is in frictional engagement with the sailboard mast.

11. The apparatus of claim 8 wherein said block holding means includes a fastening means, said fastening means being configured to permit connection of said block holding means to a planar surface.

12. The apparatus of claim 8 wherein said first and second connecting means are formed from a webbed substrate material.

13. An apparatus for separating first and second interconnected members having mating cylindrical portions, said apparatus comprising:

a) a holding means, said holding means including a first supporting means, a second supporting means and a first connecting means, said first supporting means connectable to said second supporting means, said first supporting means having a first receiving means and said second supporting means having a second receiving means, said first receiving means and said second receiving means being cooperatively aligned when said first supporting means and said second supporting means are connected together to slidingly receive one of the first member and the second member, said first connecting means having a first portion and a second portion, said first portion of said first connecting means secured to at least one of said first supporting means and said second supporting means, said second portion of said first connecting means configured to frictionally engage a portion of one of the first member and the second member that is positioned in said first and second receiving means of said first supporting means and said second supporting means, respectively; and b) a leverage means, said leverage means being securable to the other of said first member and said second member, said leverage means including an arm engaging means and a second connecting means , said arm engaging means having a cradle engaging means, said cradle engaging means configured to receive the other of the first member and the second member, said cradle engaging means having a configuration substantially complementary to the shape of the other of the first member and the second member received therein, said second connecting means having a first portion secured to said arm engaging means and a second portion configured to frictionally engage the other of the first member and the second member that is received in said arms engaging means;

c) said first receiving means of said first supporting means being an aperture configured to removably and replaceably receive at least one of the first member and the second member, and second receiving means of said second supporting means being an aperture configured to removably and replaceably receive said one of the first member and the second member.

14. An apparatus for separating first and second interconnected members having mating cylindrical portions, said apparatus comprising:

a) a holding means, said holding means including a first supporting means, a second supporting means and a first connecting means, said first supporting means connectable to said second supporting means, said first supporting means having a first receiving means and said second supporting means having a second receiving means, said first receiving means and said second receiving means being cooperatively aligned when said first supporting means and said second supporting means are connected together to slidingly receive one of the first member and the second member, said first connecting means having a first portion and a second portion, said first portion of said first connecting means secured to at least one of said first supporting means and said second supporting means, said second portion of said first connecting means configured to frictionally engage a portion of one of the first member and the second member that is positioned in said first and second receiving means of said first supporting means and said second supporting means, respectively;

b) a leverage means, said leverage means being securable to the other of said first member and said second member, said leverage means including an arm engaging means and a second connecting means, said arm engaging means having a cradle engaging means, said cradle engaging means configured to receive the other of the first member and the second member, said cradle engaging means having a configuration substantially complementary to the shape of the other of the first member and the second member received therein, said second connecting means having a first portion secured to said arm engaging means and a second portion configured to frictionally engage the other of the first member and the second member that is received in said arm engaging means; and c) a jam cleat operatively connected said holding means for securing an end of said second portion of said first connecting means that is in frictional engagement with the one of the first member and the second member.

15. An apparatus for separating first and second interconnected members having mating cylindrical portions, said apparatus comprising:

a) a holding means, said holding means including a first supporting means, a second supporting means and a first connecting means, said first supporting means connectable to said second supporting means, said first supporting means having a first receiving means and said second supporting means having a second receiving means, said first receiving means and said second receiving means being cooperatively aligned when said first supporting means and said second supporting means are connected together to slidingly receive one of the first member and the second member, said first connecting means having a first portion and a second portion, said first portion of said first connecting means secured to at least one of said first supporting means and said second supporting means, said second portion of said first connecting means configured to frictionally engage a portion of one of the first member and the second member that is positioned in said first and second receiving means of said first supporting means and said second supporting means, respectively;

b) a leverage means, said leverage means being securable to the other of said first member and said second member, said leverage means including an arm engaging means and a second connecting means, said arm engaging means having a cradle engaging means, said cradle engaging means configured to receive the other of the first member and the second member, said cradle engaging means having a configuration substantially complementary to the shape of the other of the first member and the second member received therein, said second connecting means having a first portion secured to said arm engaging means and a second portion configured to frictionally engage the other of the first member and the second member that is received in said arm engaging means; and c) a jam cleat operatively connected to said leverage means for securing an end of said second portion of said second connecting means that is in frictional engagement with the other of the first member and the second member.

16. An apparatus for separating first and second interconnected members having mating cylindrical portions, said apparatus comprising:

a) a holding means, said holding means including a first supporting means, a second supporting means and a first connecting means, said first supporting means connectable to said second supporting means, said first supporting means having a first receiving means and said second supporting means having a second receiving means, said first receiving means and said second receiving means being cooperatively aligned when said first supporting means and said second supporting means are connected together to slidingly receive one of the first member and the second member, said first connecting means having a first portion and a second portion, said first portion of said first connecting means secured to at least one of said first supporting means and said second supporting means, said second portion of said first connecting means configured to frictionally engage a portion of one of the first member and the second member that is positioned in said first and second receiving means of said first supporting means and said second supporting means, respectively; and b) a leverage means, said leverage means being securable to the other of said first member and said second member, said leverage means including an and engaging means and a second connecting means, said arm engaging means having a cradle engaging means, said cradle engaging means configured to receive the other of the first member and the second member, said cradle engaging means having a configuration substantially complementary to the shape of the other of the first member and the second member received therein, said second connecting means having a first portion secured to said arm engaging means and a second portion configured to frictionally engage the other of the first member and the second member that is received in said arm engaging means;

c) said first connecting means and said second connecting means being formed from a webbed substrate material.

* * * * *